US006799528B1

(12) United States Patent
Bekker

(10) Patent No.: US 6,799,528 B1
(45) Date of Patent: Oct. 5, 2004

(54) PORTABLE DYNAMIC POSITIONING SYSTEM WITH SELF-CONTAINED DIESEL HYDRAULIC THRUSTERS

(76) Inventor: Joannes Raymond Mari Bekker, 5206 Westridge Pl., Houston, TX (US) 77041

( * ) Notice: Subject to any disclaimer, the term of this patent is extended or adjusted under 35 U.S.C. 154(b) by 0 days.

(21) Appl. No.: 10/695,105

(22) Filed: Oct. 28, 2003

Related U.S. Application Data

(60) Provisional application No. 60/436,115, filed on Dec. 23, 2002.

(51) Int. Cl.[7] ..... B63H 25/46
(52) U.S. Cl. ..... 114/151; 440/2; 440/5
(58) Field of Search ..... 114/150, 151; 440/1, 5, 6

(56) References Cited

U.S. PATENT DOCUMENTS 4,878,864 A * 11/1989 Van Bentem ..... 440/5
6,247,421 B1 * 6/2001 Ludwigson ..... 114/265
6,257,165 B1 * 7/2001 Danos et al. ..... 114/265

* cited by examiner

*Primary Examiner*—Stephen Avila
(74) *Attorney, Agent, or Firm*—Wendy Buskop; Buskop Law Group, P.C.

(57) ABSTRACT

The integrated and self contained diesel hydraulic thruster system integral has a dynamic positioning control system for dynamic positioning of any waterborne vessel having a hull with at least two sides and a deck connecting the sides, at least two removably mounted azimuthing thrusters, at least two self-contained diesel hydraulic power units removably secured to the deck, one for each thruster, at least one dynamic positioning computer connected to each of the self contained diesel hydraulic power units, at least one motion reference sensor connected to the dynamic positioning computer to correct reference position signals for motion of the vessel, at least one heading sensor, and at least one sensor that is either a position reference sensor connected to the dynamic positioning computer, an environmental sensor connected to the dynamic positioning computer, or a combination thereof.

15 Claims, 4 Drawing Sheets

PORTABLE DYNAMIC POSITIONING SYSTEM WITH SELF-CONTAINED DIESEL HYDRAULIC THRUSTERS

The present application claims priority from co-Pending U.S. Provisional Patent Application Serial No. 60/436,115 titled "PORTABLE DYNAMIC POSITIONING SYSTEM WITH SELF-CONTAINED DIESEL HYDRAULIC THRUSTERS," filed in the Patent and Trade Office on Dec. 23, 2002.

FIELD

The embodiments pertain to an integrated positioning and maneuvering system mounted on a vessel hull. More particularly, the embodiments pertain to the portability and installation methods that provide deployed and elevated (service or maintenance) positions of the thrusters and their self-contained power systems and controls relative to a vessel hull.

BACKGROUND

Many different types of work performed at sea or on the ocean floor require vessels, barges or other floating platforms that need to hold station in open sea or accurately follow pre-determined tracks relative to the ocean floor. Projects requiring such vessels include offshore drilling, subsea pipelay and cable lay, subsea construction, salvage and recovery, oceanographic research, etc.

The vessels, barges and floating structures used for such projects are often equipped with multiple anchors and winches, commonly referred to as anchor mooring systems. They require support of anchor handling vessels to position the anchors at pre-determined locations and move the anchors as needed.

As oil and gas exploration is extending farther and farther offshore from land, more and more of these projects are taking place in water depth sufficiently great that it is impractical, sometimes impossible to use anchor mooring systems. Even in some shallow water areas, the use of anchor mooring systems may be prohibited, for instance, due to the presence of coral reefs or in locations where there already are multiple pipe lines and cables on the ocean floor and the use of anchors could damage the coral reefs or break existing pipe lines and cables.

It is known that for such applications, vessels, barges and floating structures equipped with dynamic positioning systems are used. These vessels are equipped with multiple thrusters operated by computers to adjust and maintain the heading and the positioning of the vessel against environmental forces of current, wind and waves. The thrusters include propellers that are operated to create thrust forces that are applied to the vessel for movement of the vessel in desired directions. In a tunnel thruster, the propeller is located in a tunnel that extends transversely through the vessel below its water line, usually near the bow or the stern of the vessel. Tunnel thrusters are used in combination with the conventional fixed axis propulsive propellers at the stem of the vessel to adjust and to maintain the heading in the position of the vessel over a defined spot on the sea floor.

Retractable and steerable thrusters are also known in the context of dynamically positioned ships and other floating facilities. Whereas tunnel thrusters generally apply thrust reaction forces to a vessel only in one or the other of two opposite directions transversely of the vessel hull, steerable thrusters apply thrust reaction forces in any desired horizontal direction relative to the hull. For that reason, steerable thrusters are increasingly preferred for vessels, barges and floating structures requiring station keeping in open waters without using anchors.

Most steerable thrusters are installed inside the hull, extending through the bottom of the vessel. They are powered by electric motors and the electrical power is provided by large generator sets installed inside machinery rooms of the vessel. These thrusters and power systems are permanent fixtures and completely integrated within the vessel through electrical power distribution, control power, cooling water systems, fuel systems, structural support, etc.

A portable positioning system with portable thrusters, self-contained power units and a dedicated control system has long been needed, where the thrusters, power units and controls are not integral with any of the ships systems or integral with the hull of the ship and allow easy attachment to a mono-hull or multi-hull ship and easy removal when the system is no longer required for that vessel but can be installed on a different vessel for another application.

Additionally, a need has existed for a modular system that can easily be increased or reduced in overall size and capacity to suit individual project application requirements and for adaptation to different size vessels, barges or other floating structures.

Additionally, a need has existed for a fully packaged, self-contained system that is fully integrated, factory tested and class approved before installation on the ship, allowing vessel upgrades to dynamic positioning capability within just a few days and at minimal cost.

Additionally, a need has existed for a system which is easy to service at sea allowing minimal down time without the need for a shipyard or dry dock, allowing the vessel to continue operating at its work location without interruption, hence increasing the profitability of the operation.

This system meaningfully addresses the above needs in the context of dynamic positioning of vessels, barges and other floating structures.

SUMMARY

The system is an integrated and self-contained diesel hydraulic thruster system integral with a dynamic positioning control system for dynamic positioning of any water borne vessel having a hull and a deck. The inventive system has at least two and preferably more azimuthing thrusters, each removably mounted to the exterior of the vessel.

Each thruster is removably secured to the deck or the side of the vessel and is provided with its own dedicated self-contained diesel hydraulic power unit which is removably secured to the deck of the vessel. An electrical control cable and a bundle of hydraulic hoses make up the connection between each thruster and its diesel hydraulic power unit. A central control system, removably installed in an elevated control house on the vessel, connects with electrical control cables to each of the diesel hydraulic power units. Various environmental sensors and position reference sensors are removably installed on the vessel and connect with electrical control cables to the central control system.

Each thruster includes a skid removably mounted to the deck or side of the vessel. The skid accommodates the upper thruster housing, which is moveably connected to the skid. The upper thruster housing contains the azimuthing drive and feedback assembly, consisting of steering gear with hydraulic slewing drive and electrical steering angle feedback sensors. The upper thruster housing also contains a multi-port hydraulic swivel assembly, providing uninterrupted hydraulic fluid transmission to the hydraulic propeller motor while allowing free azimuthing of the thruster.

The thruster further includes a stem connected to the thruster upper housing steering gear and suspending the thruster pod in the water preferably below the bottom of the vessel. The thruster pod contains a hydraulic motor and a drive shaft connected to the hydraulic motor on one end and at least one propeller with nozzle on the other end. A strut connects the thruster pod to the stem. A bundle of hydraulic hoses is contained within the stem and the strut, connecting to the multi-port hydraulic swivel in the upper thruster housing on one end and to the hydraulic motor in the thruster pod on the other end.

Each self-contained diesel hydraulic power unit comprises a skid-mounted enclosure containing a diesel engine connected to hydraulic pumps. The enclosure further comprises a fuel day tank for supplying fuel to the engine, a cooling system for the engine and a cooling system for the hydraulic fluid, an exhaust system for the engine, an electric starter for the engine, electrical batteries, an engine mounted alternator for charging the batteries, a hydraulic reservoir and an electrical control system for start-up and local control of the thruster.

The central control system comprises at least one dynamic positioning computer with peripherals and connected to a signal interface for communicating with each self-contained diesel hydraulic power unit and with the sensor suite of position reference sensors and environmental sensors.

Sensors are provided for vessel heading, vessel position, wind speed and direction and vessel motion reference.

BRIEF DESCRIPTION OF THE DRAWINGS

The above-mentioned and other features of this system are more fully set forth in the following detailed description of presently preferred and other structures and procedures which implement this system. The description is presented with reference to the accompanying drawings in which.

The present system is detailed below with reference to the listed Figures.

DETAILED DESCRIPTION OF THE PREFERRED EMBODIMENTS

Before explaining the present apparatus in detail, it is to be understood that the apparatus is not limited to the particular embodiments and that it can be practiced or carried out in various ways.

Figure 1:
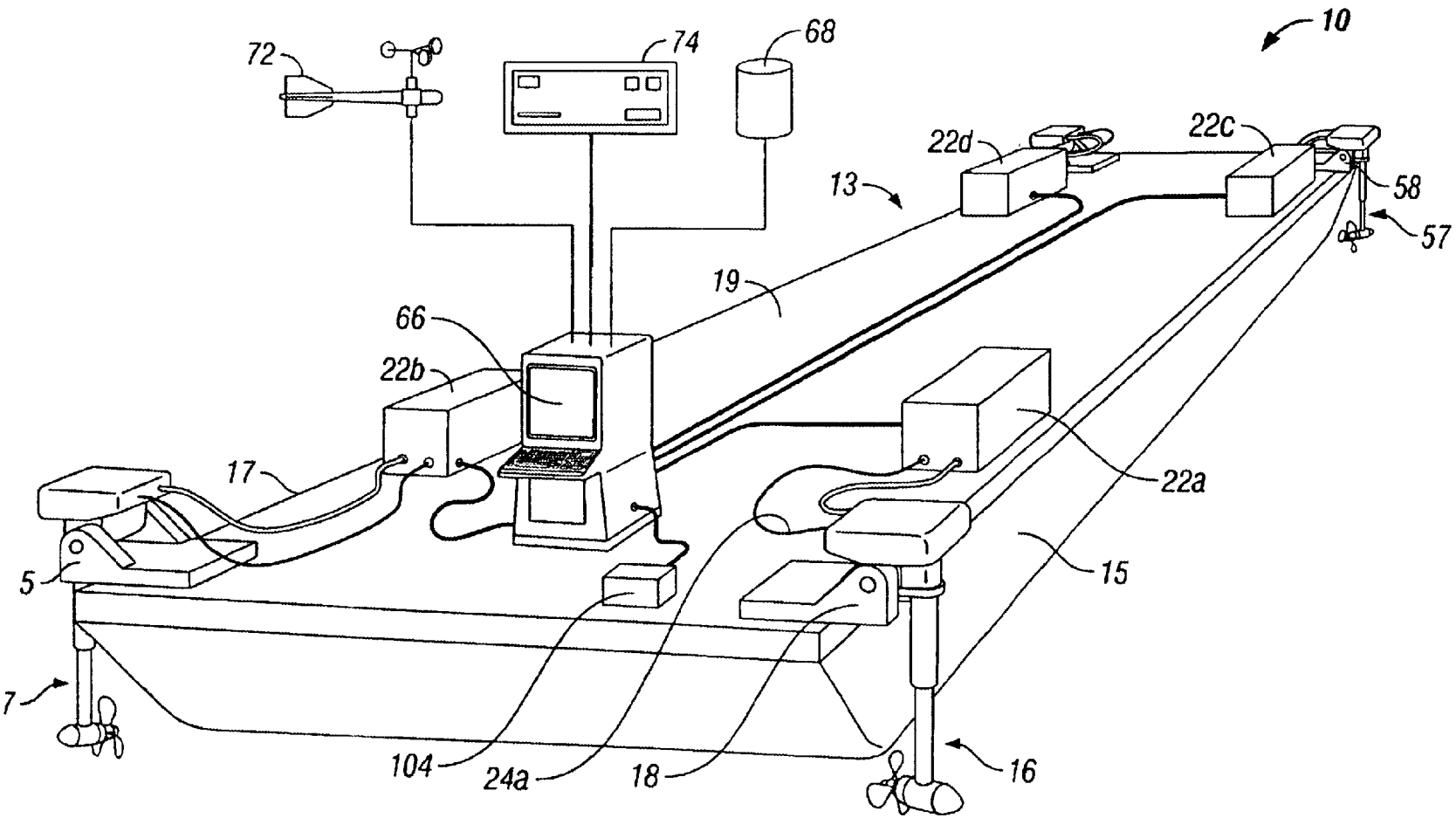
FIG. 1 depicts a perspective view of a hull which incorporates four steerable and retractable thrusters as components of its propulsion and dynamic positioning system.

The system as shown in FIG. 1 is an integrated and self-contained diesel hydraulic thruster system (10) for dynamic positioning of any waterborne vessel (13). In this FIG. 1, the vessel is shown to be a barge. The vessel preferably has a hull with at least two sides. For the mono-hull barge shown in FIG. 1, the port side is (15) and the starboard side is (17). A deck (19) connects the sides.

The thruster system is configured from at least two azimuthing thrusters (7) and (16). Each azimuthing thruster is removably mounted to the hull of the vessel.

The azimuthing thruster is mounted to the hull with a skid. FIG. 1 shows that azimuthing thruster (7) is removably mounted to the deck (19) with a skid (5). Similarly, azimuthing thruster (16) is removably mounted to the deck (19) with skid (18).

Figure 2:
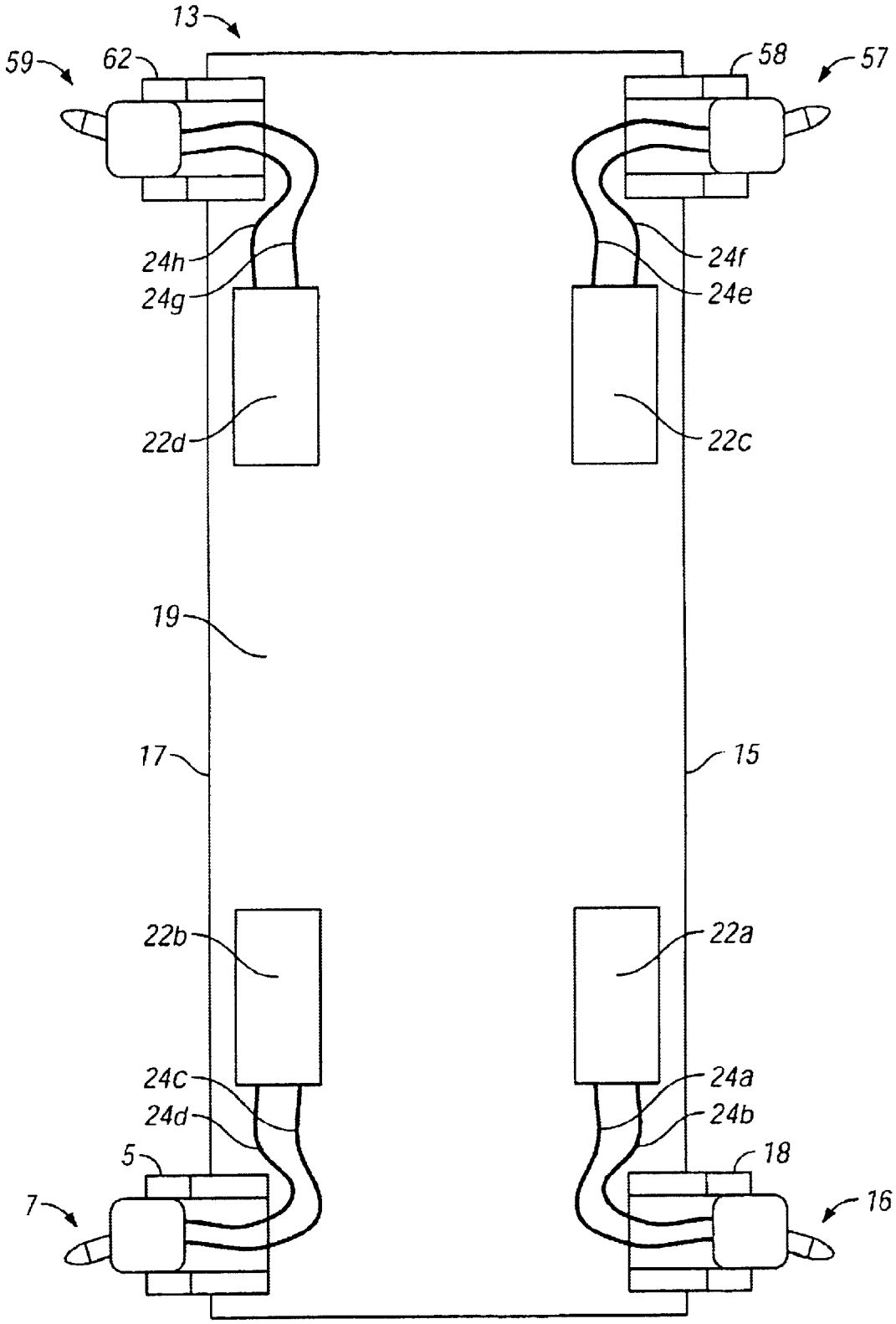
FIG. 2 depicts a top view of the deck of a vessel with a four thruster system removably attached to the deck.

FIG. 2 shows a top view of the preferred embodiment wherein four thrusters (7, 16, 57, and 59) are mounted to the deck. Skids (5, 18, 58 and 62) are also shown in FIG. 2.

Returning to FIG. 1, a self-contained diesel hydraulic power unit (22*a*) is removably secured to the deck (19) and then hydraulically connected by hoses (24*a*) and electrical control cable (24*b*) to thruster (16). Similarly, as shown in FIG. 2, a self-contained diesel hydraulic power unit (22*b*) is removably secured to the deck (19) and then hydraulically connected by hoses (24*c*) and electrical control cable (24*d*) to thruster (7). Continuing, a self-contained diesel hydraulic power unit is connected to each of the remaining thrusters with hydraulic hoses and electrical control cable. For thruster (57), the diesel hydraulic power unit (22*c*) is connected by hydraulic hoses (24*e*) and electrical control cable (24*f*) to thruster (57) and diesel hydraulic power unit (22*d*) is connected by hydraulic hoses (24*g*) and electrical control cable (24*h*) to thruster (59).

The system also contemplates that the dynamic positioning computer (66) can include at least one uninterruptible power source (104) connected to the dynamic positioning computer (66).

At least one dynamic positioning computer (66) is connected to each self-contained diesel hydraulic power unit. At least one motion reference sensor (74) is connected to the dynamic positioning computer to correct position reference signals for motion of the vessel. One or more position reference sensors (68) are connected to the dynamic positioning computer (66), and one or more environmental sensors (72) are connected to the dynamic positioning computer (66). Various combinations of sensors can be used with the novel system.

Figure 3:
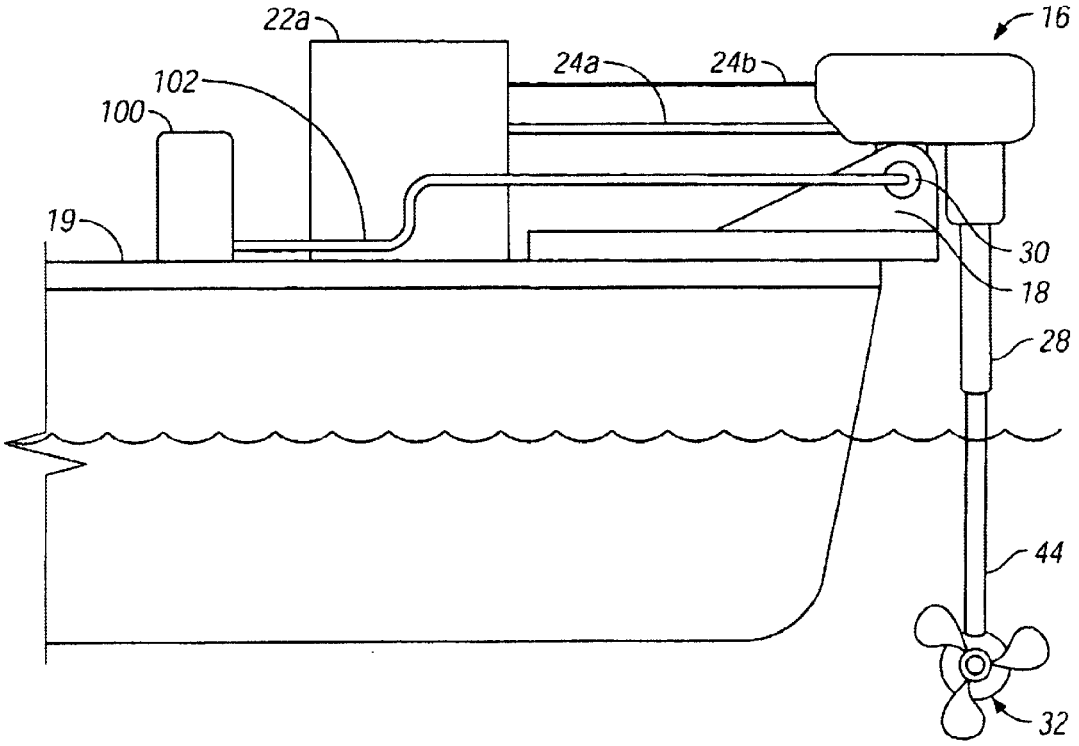
FIG. 3 depicts a detailed side view of a station keeping thruster illustrated in its deployed (lowermost) position relative to the hull of the vessel.

FIG. 3 shows a detail of how the hydraulic hoses connect to the thruster that further has a connector (30) for hydraulically lowering and raising a stem (28). At the lower end of the stem (28) is a strut (44). A hydraulic pod (32) connects to the strut.

Figure 4:
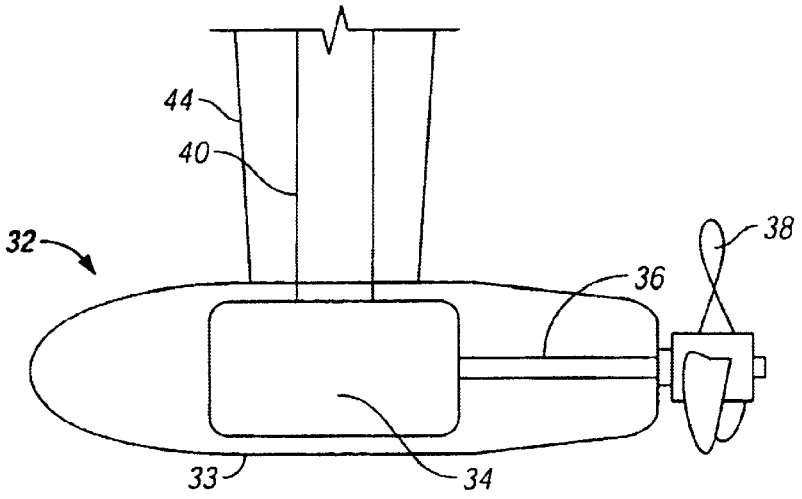
FIG. 4 depicts a more detailed cross-sectional elevation view showing the hydraulic pod of a thruster and propeller.

FIG. 4 shows a detail of the hydraulic pod (32) that contains a hydraulic motor (34). A drive shaft (36) is connected to the hydraulic motor (34) on one end. At least one propeller (38) is connected to the drive shaft (36) on the other end. A bundle of hydraulic hoses (40) is used for connecting from the multi-port hydraulic swivel in the upper thruster housing on one end and the hydraulic motor in the pod on the other end.

Figure 5:
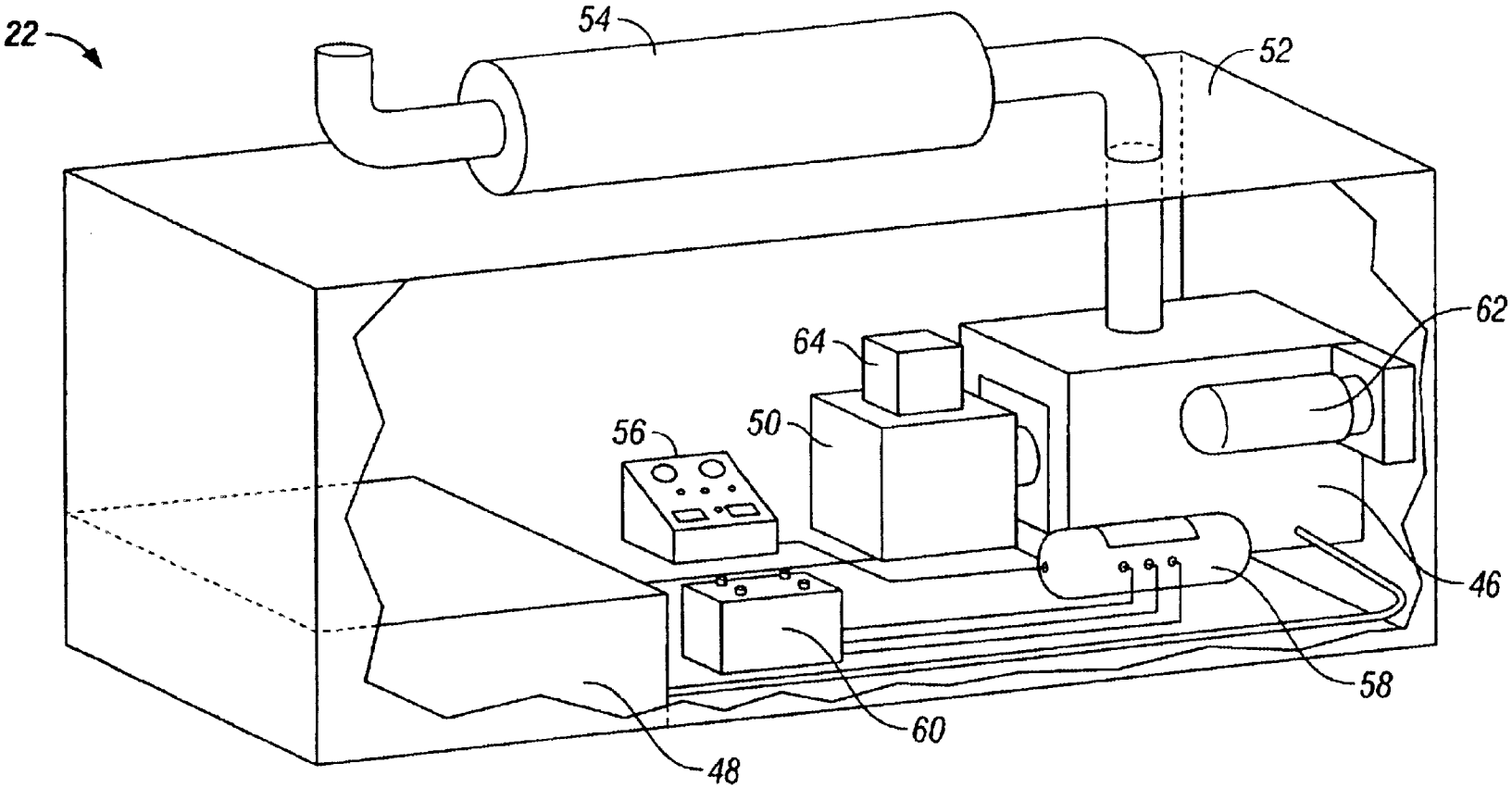
FIG. 5 depicts a perspective view of the interior of the self-contained hydraulic power unit.

FIG. 5 shows the self-contained diesel hydraulic power unit (22) usable in this system. The self-contained diesel hydraulic power unit has a housing (52) containing a diesel engine (46), a fuel day tank (48), an exhaust system (54) for the engine, and an alternator (62) for the engine. An electrical control system (56) connecting an electric starter (58) can be used to engage or start the engine. A battery (60) can also be used to run the starter. The diesel engine is connected to a hydraulic pump (50) with a hydraulic reservoir (64). The self-contained diesel hydraulic power unit can incorporate a cooling system (not shown).

In an alternative embodiment, the system can include one or more hydraulic cylinders shown in FIG. 3 as element (100) that can connect through hoses (102) to the connector (30). The hydraulic cylinders can then be used to tilt the stem (28) upwardly to a stowed position whereby the thruster is completely out of the water, allowing for easy transit of the vessel and which enables work or maintenance to be performed on the thruster without the need of a dry dock.

The position reference sensors can be one or more of the following sensors: global positioning system (GPS) sensors preferably with differential correction, hydro-acoustic sensors for determining a location relative to a moving underwater target or a fixed point on a sea bottom, fan beam laser sensors for determining a location relative to a fixed structure above the sea, sensors, current sensors and combinations of environmental sensors.

Additionally, it is contemplated that each diesel engine can range from about 150 hp to about 1000 hp.

In an alternative embodiment, the connector (30) is contemplated to be a hinge.

In another embodiment of the system, the stem can be fixedly mounted to the skid, such as using bolts or welding.

In still another embodiment of the system, the thruster is mounted to the side of the hull above the water line of the vessel.

When any repairs are needed, a thruster can be removed from and returned to service in the shortest time possible. Time consuming keel hauling of the thruster head assembly from below the hull onto a weather deck and back are avoided, as are diving operations in support of keel hauling or other service procedures addressing a thruster requiring maintenance or repair. Thruster repair or maintenance activities can be pursued while the vessel continues operations or is in transit.

The present system has been described above in the context of present by preferred and other structural arrangement and procedures that embody and implement the system. The foregoing description is not intended as an exhaustive catalog of all structural arrangements and procedures embodying the system, or of contexts in which the system can be used to an advantage.

While the presently preferred usage context of the system is dynamic positioning of vessels, barges and other floating structures, it can be used in many forms of seaborne as well as inland water borne operations or installations, such as dredging, deep sea mining, seismic operations, surveys, pipe and cable laying, subsea construction and repair, salvage and recovery, offshore drilling, military operations, oceanographic research and others, whereby the vessels or structures are or may be required to maintain a desired station or to move in any desired horizontal direction with or without a change of heading.

Further, variations of or modifications to the structures and procedures described above may be made without departing from the fair scope and content of this system. For those reasons, the following claims are to be read and interpreted consistently with and in support of that fair scope and content.

What is claimed is:

1. An integrated and self contained diesel hydraulic thruster system integral with a dynamic positioning control system for dynamic positioning of any waterborne vessel having a hull with at least two sides and a deck connecting the sides, comprising:

a. at least two azimuthing thrusters, each removably mounted to the vessel, comprising:

i. a skid removably secured to the deck;

ii. an upper thruster housing, removably connected to the skid, containing steering gear with hydraulic slewing drive and electrical steering angle feedback sensors and a multi-port hydraulic swivel assembly;

iii. a stem moveably connected with a connector to the skid;

iv. a strut connected to the stem;

v. a hydraulic pod connected to the strut; wherein the pod comprises a housing a hydraulic motor contained within the housing;

vi. a drive shaft connected to the hydraulic motor on one end;

vii. at least one propeller with nozzle connected to the drive shaft; and viii. a bundle of stem hydraulic hoses connecting on one end to the multi-port hydraulic swivel assembly and on the other end to the hydraulic motor;

b. at least two self-contained diesel hydraulic power units removably secured to the deck, one for each thruster, comprising:

i. a housing comprising a diesel engine with a fuel day tank, wherein the diesel engine is connected to a hydraulic pump with a hydraulic reservoir and a hydraulic cooler;

ii. a cooling system for the engine;

iii. an exhaust system for the engine;

iv. an alternator for the engine;

v. an electrical control system for the engine;

vi. an electric starter for the engine;

vii. a battery for the engine; and viii. a bundle of hydraulic hoses and an electrical control cable, each having a first and second end, wherein each the first ends are secured to the hydraulic power unit and the other ends are secured to the thruster skid;

c. at least one dynamic positioning computer connected to each of the self contained diesel hydraulic power units;

d. at least one motion reference sensor connected to the dynamic positioning computer to correct reference position signals for motion of the vessel;

e. at least one heading sensor; and f. at least one sensor selected from the group consisting of position reference sensors connected to the dynamic positioning computer; environmental sensors connected to the dynamic positioning computer; and combinations thereof.

2. The system of claim 1, wherein one or more hydraulic cylinders at the connector are used to tilt the stem upwards to a stowed position of the thruster, whereby the thruster is completely out of the water.

3. The system of claim 1, wherein the position reference sensors are selected from the group consisting of global positioning system (GPS) sensors; hydro-acoustic sensors; fan beam laser sensors; Artimis system signal sensors; vertical taut wire system sensors, horizontal taut wire system sensors; and differential and absolute reference positioning system (DARPS) sensors.

4. The system of claim 1, wherein the environmental sensors are selected from the group consisting of wind sensors, current sensor and combinations thereof.

5. The system of claim 1, wherein the dynamic positioning computer further comprises at least one uninterruptible power source connected to the computer.

6. The system of claim 1, wherein the diesel engine ranges from about 150 horsepower to about 1000 horsepower.

7. The system of claim 1, wherein the motor is a variable speed hydraulic motor.

8. The system of claim 1, wherein the motor is reversible.

9. The system of claim 1, wherein the connector is a hinge.

10. The system of claim 1, wherein the stem is bolted to the skid.

11. The system of claim 1, wherein the stem further comprises at least one hydraulic cylinder connected to the stem to raise or lower the stem.

12. The system of claim 1, wherein the thruster is mounted to the deck of the vessel.

13. The system of claim 1, wherein the thruster is mounted to the side of the hull above the water line of the vessel.

14. The system of claim 1, comprising at least two thrusters.

15. A waterborne vessel comprising at least two thrusters as defined in claim 1.

* * * * *